US008104570B2

(12) United States Patent
Miller et al.

(10) Patent No.: US 8,104,570 B2
(45) Date of Patent: Jan. 31, 2012

(54) SUPPRESSOR

(75) Inventors: Brett Kent Miller, Middleburg, VA (US); William Scott Sawyer, Moyock, NC (US)

(73) Assignee: CanCorp, LLC, Middleburg, VA (US)

( * ) Notice: Subject to any disclaimer, the term of this patent is extended or adjusted under 35 U.S.C. 154(b) by 0 days.

(21) Appl. No.: 12/926,737

(22) Filed: Dec. 7, 2010

(65) Prior Publication Data

US 2011/0132683 A1 Jun. 9, 2011

Related U.S. Application Data

(60) Provisional application No. 61/267,895, filed on Dec. 9, 2009.

(51) Int. Cl.
*F41A 21/00* (2006.01)

(52) U.S. Cl. ..... 181/223; 89/14.4

(58) Field of Classification Search ..... 181/223; 89/14

See application file for complete search history.

(56) References Cited

U.S. PATENT DOCUMENTS 3,500,955 A * 3/1970 Werbell ..... 181/223
3,704,763 A * 12/1972 Becker et al. ..... 181/268
4,588,043 A * 5/1986 Finn ..... 181/223
4,869,151 A * 9/1989 Chahin ..... 89/14.3
4,880,078 A * 11/1989 Inoue et al. ..... 181/232
4,939,977 A * 7/1990 Stroup ..... 89/14.4
5,029,512 A * 7/1991 Latka ..... 89/14.4
6,412,389 B2 * 7/2002 Fluhr ..... 89/14.4
6,899,008 B2 * 5/2005 Breuer ..... 89/14.3
7,308,967 B1 * 12/2007 Hoel ..... 181/223
7,856,914 B2 * 12/2010 Shults et al. ..... 89/14.4

* cited by examiner

*Primary Examiner* — Forrest M Phillips
(74) *Attorney, Agent, or Firm* — Finnegan, Henderson, Farabow, Garrett & Dunner, LLP

(57) ABSTRACT

A suppressor for suppressing sounds generated by the discharge of a firearm, the discharge generating propellant gases is disclosed. The suppressor includes a host tube. The host tube is generally hollow and generally cylindrical. The suppressor also includes a monolithic baffle stack inserted within the host tube and secured to a first end of the host tube. The monolithic baffle stack includes a first end that includes a first hole. The monolithic baffle stack also includes a second end that includes a second hole. The second end is located opposite the first end of the monolithic baffle stack. The monolithic baffle stack further includes a plurality of chambers in fluid communication with each other via a plurality of holes. The monolithic baffle stack also includes a plurality of recesses in fluid communication with the plurality of chambers via a plurality of side holes. The suppressor further includes a cap secured to a second end of the host tube. The cap includes a hole. Moreover, the suppressor includes a path extending from the first hole adjacent the first end of the monolithic baffle stack through the hole of the cap. The plurality of chambers, the plurality of recesses, and the path are configured to allow propellant gases to travel therethrough.

20 Claims, 4 Drawing Sheets

SUPPRESSOR

RELATED APPLICATION

The present disclosure claims the benefit of previously filed U.S. Patent Provisional Application No. 61/267,895, filed on Dec. 9, 2009, the content of which is hereby incorporated by reference.

TECHNICAL FIELD

The present disclosure relates generally to suppressors, and more particularly, to suppressors for firearms.

BACKGROUND

When a firearm is fired, multiple sounds may be generated. These sounds may be generated from ignition of a round, from the discharge of propellant gas from the end of the barrel of a firearm, from the bullet in flight, from the bullet when it finds terminal impact, etc. Multiple techniques may be employed to address these sounds. Typically, a firearm suppressor (commonly known as a silencer) may be capable of addressing some of these sounds associated with firing of the firearm.

A suppressor generally takes the form of a cylindrically shaped metal tube with various internal mechanisms to reduce the sound of firing by slowing the escaping propellant gas and sometimes by reducing the velocity of the bullet. The suppressor is typically made of metal (e.g., steel, aluminum, or titanium) that can withstand the heat associated with the escaping propellant gas. Efforts have been made to reduce the overall weight of the suppressor. However, efforts to build lighter suppressors have compromised the durability of the suppressors by using thin metals.

A suppressor may include a cylindrical core containing expansion chambers. The suppressor may be attached to the barrel of a firearm. The suppressor may also be attached to different firearms of the same caliber. Caliber refers to the approximate diameter of the barrel (and the bullet) of a firearm, which is generally measured in inches or millimeters.

A suppressor may help to reduce noise by trapping the propellant gases from the firing of the cartridge inside a series of hollow (expansion) chambers. As the trapped gas expands and cools through the series of chambers, its pressure and velocity decrease. The series of chambers may be divided by baffles, which are metal dividers that separate the expansion chambers. Each baffle may include a hole in its center to permit the passage of the bullet through the suppressor. The hole is typically larger than the bullet caliber to minimize the risk of "baffle strike," i.e., the bullet contacting the baffle. Baffles may be made of similar or different material as the cylindrical core. The shape of each baffle may include a flat or a curved surface. One popular technique includes forming a stack of baffles using alternating angled flat surfaces. In this technique, the stack of baffles may be welded to the cylindrical core. By doing so, however, the stack of baffles may not be removed from the cylindrical core for replacement or for cleaning purposes.

In another technique, a stack of baffles may be formed by welding individual baffles together. The stack of baffles may then be welded to the cylindrical core. In this technique, the joints where the individual baffles are welded together, or where the stack of baffles are welded to the cylindrical core, may suffer from fatigue over time and may eventually become a point of failure. In addition, the materials used in forming the welded joints may increase the overall weight of the suppressor.

The apparatus of the present disclosure are directed toward improvements in the existing technology.

SUMMARY

In one aspect, the present disclosure may be directed to a suppressor for suppressing sounds generated by the discharge of a firearm. The discharge may generate propellant gases. The suppressor may include a host tube. The host tube may be generally hollow and generally cylindrical. The suppressor also may include a monolithic baffle stack inserted within the host tube and secured to a first end of the host tube. The monolithic baffle stack may include a first end that may include a first hole. The monolithic baffle stack also may include a second end that may include a second hole. The second end may be located opposite the first end of the monolithic baffle stack. The monolithic baffle stack further may include a plurality of chambers in fluid communication with each other via a plurality of holes. The monolithic baffle stack also may include a plurality of recesses in fluid communication with the plurality of chambers via a plurality of side holes. The suppressor further may include a cap secured to a second end of the host tube. The cap may include a hole. Moreover, the suppressor may include a path extending from the first hole adjacent the first end of the monolithic baffle stack through the hole of the cap. The plurality of chambers, the plurality of recesses, and the path may be configured to allow propellant gases to travel therethrough.

In another aspect, the present disclosure is directed to a suppressor for suppressing sounds generated by the discharge of a firearm. The discharge may generate propellant gases. The suppressor may include a host tube. The host tube may be generally hollow and generally cylindrical. The suppressor may also include a baffle stack selectively inserted within the host tube and secured to a first end of the host tube via corresponding threaded portions. The baffle stack may include a plurality of chambers in fluid communication with each other via a plurality of holes. The baffle stack may also include a plurality of recesses in fluid communication with the plurality of chambers via a plurality of side holes. The suppressor may further include a cap selectively secured to a second end of the host tube via corresponding threaded portions. The cap may include a hole. Moreover, the suppressor may include a path extending from the first hole adjacent the first end of the baffle stack through the hole of the cap. The plurality of chambers, the plurality of recesses, and the path may be configured to allow propellant gases to travel therethrough.

In yet another aspect, the present disclosure is directed to a method of assembling a suppressor for suppressing sounds generated by the discharge of a firearm. The discharge may generate propellant gases. The method may include providing a host tube. The host tube may be generally hollow and generally cylindrical in shape. The method may also include providing a monolithic baffle stack. The monolithic baffle stack may include a first end that may include a first hole. The monolithic baffle stack may also include a second end that may include a second hole. The second end may be located opposite the first end of the monolithic baffle stack. The monolithic baffle stack may further include a plurality of chambers in fluid communication with each other via a plurality of holes. The monolithic baffle stack may also include a plurality of recesses in fluid communication with the plurality of chambers via a plurality of side holes. The method may further include securing the first end of the monolithic baffle to a first end of the host tube. The method may include providing a cap. The cap may include a hole. The method may also include securing the cap to a second end of the host tube. A path may extend from the first hole adjacent the first end of the monolithic baffle stack through the hole of the cap. The plurality of chambers, the plurality of recesses, and the path may be configured to allow propellant gases to travel therethrough.

DETAILED DESCRIPTION

Figure 1:
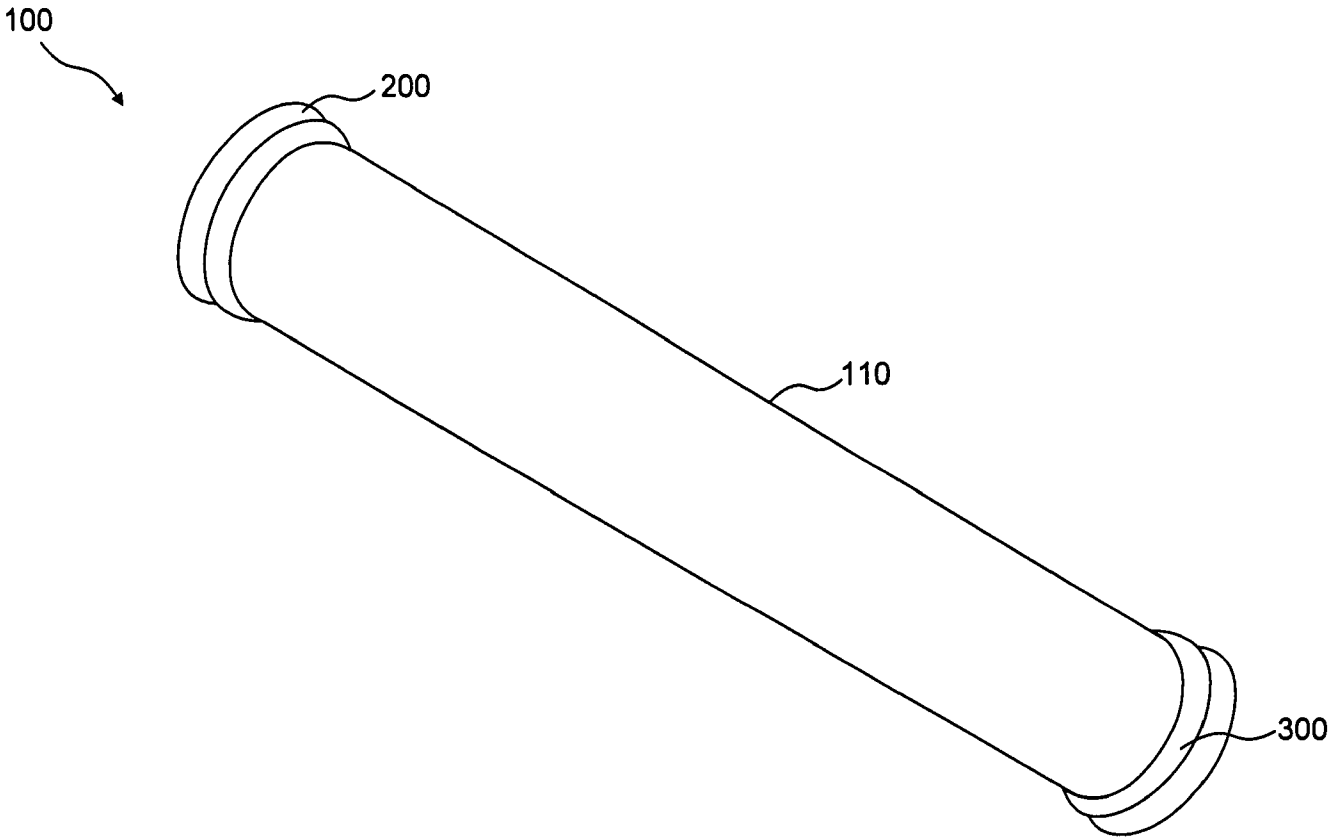
FIG. 1 is a perspective view of an exemplary embodiment of a suppressor.

An exemplary embodiment of a suppressor 100 for reducing sounds generated during firing of a firearm is illustrated in FIG. 1. In the embodiment as shown, suppressor 100 is fully assembled. In some embodiments, suppressor 100 may include a host tube 110, a baffle stack 200, and a cap 300. Once assembled, suppressor 100 may be removably attached to a firearm.

Suppressor 100 may include two ends. In the embodiment as shown, suppressor 100 includes one end that coincides with an end of host tube 110. Also as shown, suppressor 100 includes another end that coincides with an end of cap 300. As will be explained in further detail below, both ends of suppressor 100 may be threaded. It is contemplated that suppressor 100 may be removably attached to a firearm via either threaded end. For example, suppressor 100 may be removably attached to a firearm via the end that coincides with the end of host tube 110. For another example, suppressor 100 may be removably attached to a firearm via the end that coincides with the end of cap 300.

Figure 2:
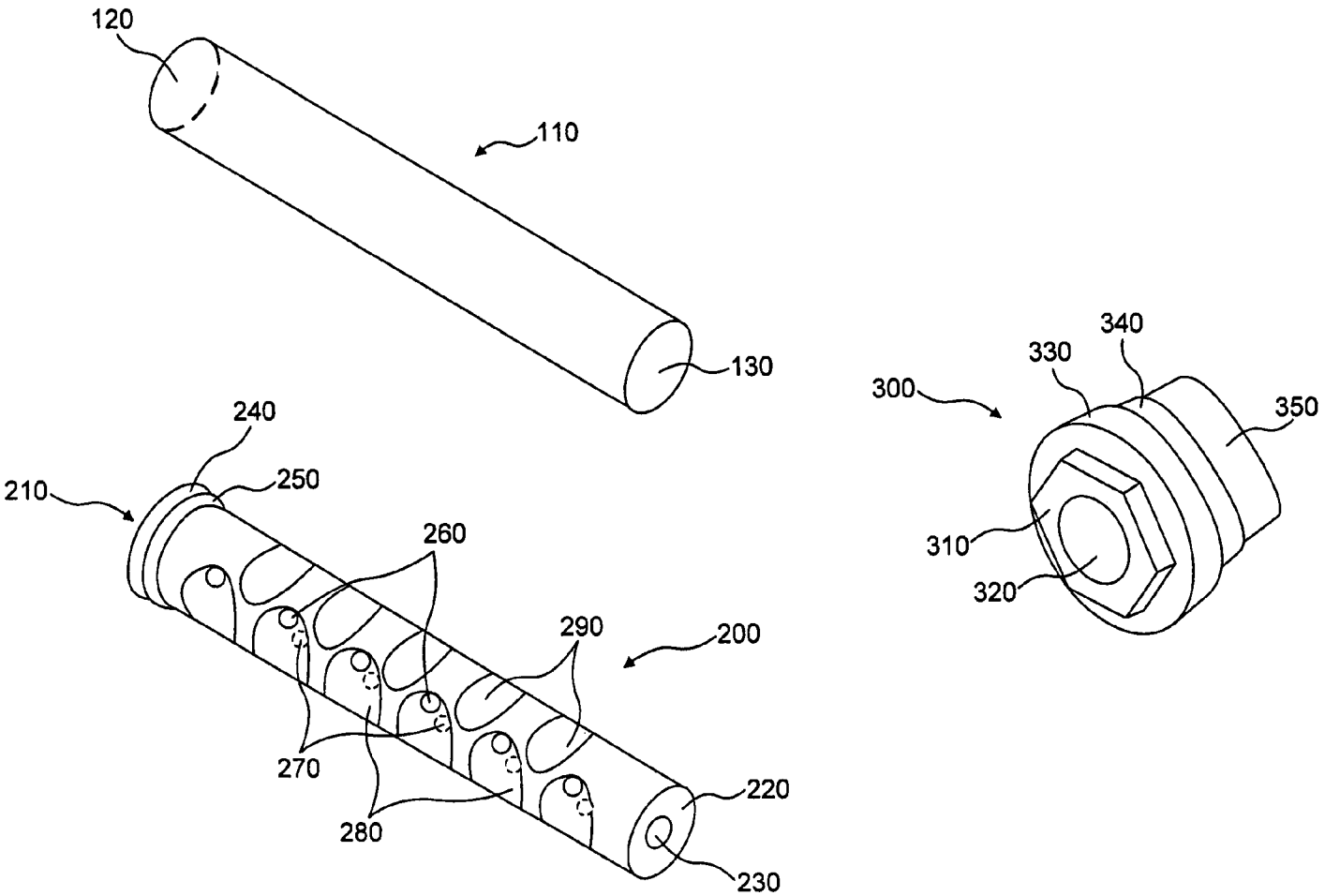
FIG. 2 is a perspective view of exemplary embodiments of a host tube, a baffle stack, and a cap.

FIG. 2 illustrates an exemplary embodiment of suppressor 100 in a disassembled state, e.g., before the various components of suppressor 100 are assembled. Those skilled in the art would appreciate that because suppressor 100 may be disassembled easily, the life and durability of suppressor 100 may be increased. For example, any component of suppressor 100 may be replaced. Thus, instead of replacing suppressor 100 in its entirety when any component requires replacement, only the damaged component needs to be replaced.

Still referring to FIG. 2, host tube 110 may be a generally hollow and cylindrical tube. Host tube 110 may represent other geometric shapes that may be suitable for use in a suppressor. For example, host tube 110 may be in the shape of a prism, a box, or any other polygon. Host tube 110 may include a first end 120 and a second end 130. In some embodiments, first end 120 and second end 130 may be threaded. Host tube 110 may be approximately 6 to 10 inches in length, and may be approximately 1 to 2 inches in diameter, for example. It is contemplated that other dimensions of host tube 110 may be appropriate depending on the type of firearm for which suppressor 100 is designed. In some embodiments, host tube 110 may be made of titanium. In other embodiments, host tube 110 may be made of other metal such as steel, aluminum, copper, brass, metal alloys, or any appropriate metal. It is contemplated that the various components of suppressor 100 may be made of the same material. In one embodiment, the various components of suppressor 100 may be made of titanium. A suppressor made of titanium may be lower in weight as compared to a suppressor made of steel. Those skilled in the art would appreciate that a lightweight suppressor may be preferable over a heavier suppressor.

As shown in FIG. 2, baffle stack 200 may be a monolithic baffle stack, i.e., a single piece baffle stack as opposed to being made from multiple individual baffles. Using a monolithic unit may help to minimize or eliminate point of impact shift (i.e., deviation between a target path and the actual path of the bullet) during firing of a firearm. Baffle stack 200 may be approximately 5½ inches to 9 inches in length and approximately ⅞ inch to 1 15/16 inches in diameter. In the embodiment as shown, baffle stack 200 includes a first end 210 that includes a first protrusion 240 and a second protrusion 250. First protrusion 240 may have a thickness, i.e., distance measured along a longitudinal axis extending from first end 210 to second end 220, of approximately ⅛ inch to ⅜ inch. Second protrusion 250 may have a similar thickness of approximately ⅛ inch to ⅜ inch. First protrusion 240 may have a diameter of approximately 1 inch to 2.5 inch. Second protrusion 250 may have a diameter less than the diameter of first protrusion 240, which may be approximately ⅞ inch to 2⅜ inch.

In some embodiments, first end 210 may include a hole 245 (referring to FIGS. 3B-C) that may be approximately ¾ inch to 1½ inches in diameter. Baffle stack 200 includes a second end 220 that includes a hole 230. Hole 230 may be similar in size as hole 245. Baffle stack 200 may include a plurality of holes 260, a plurality of side holes 270, a plurality of chambers 280, and a plurality of recesses 290. In some embodiments, each of the plurality of holes 260 may be similar in size as hole 230, and may be approximately ¾ inch to 1½ inches in diameter. Each of the plurality of side holes 270 may be approximately ⅛ inch to ⅜ inches in diameter. As shown in FIGS. 3A-B, the location of the plurality of side holes 270 may be symmetrical with respect to a longitudinal axis extending from first end 210 to second end 220. It is contemplated that the number and location of side holes 270 may vary.

Figure 3C:
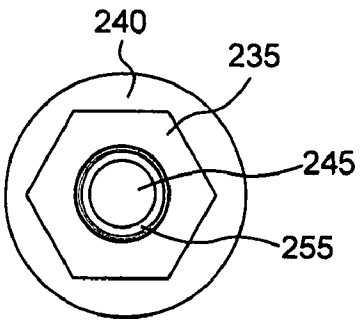
FIG. 3C is an end view of the baffle stack of FIG. 2.
Figure 3A:
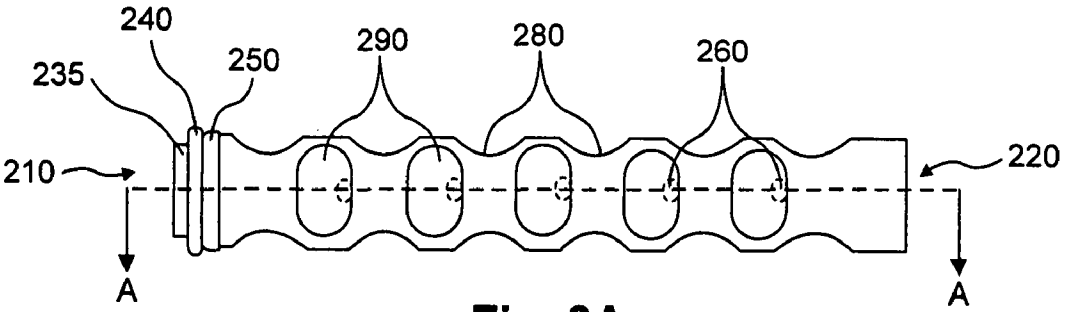
FIG. 3A is a side view of the baffle stack of FIG. 2.
Figure 3B:
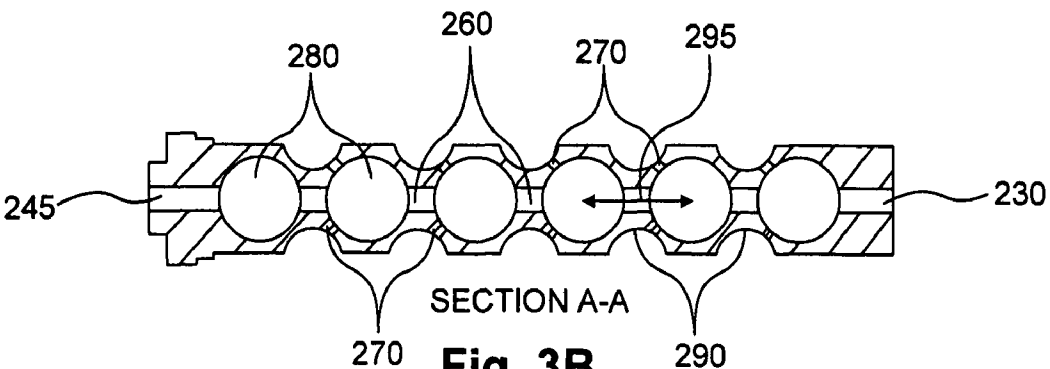
FIG. 3B is a cross-sectional view of the baffle stack of FIG. 2.

FIGS. 3A-C show a side view, a cross-sectional view, and an end view of an exemplary embodiment of baffle stack 200, respectively. In some embodiments, first end 210 may include an external protrusion 235 in addition to first protrusion 240 and second protrusion 250. External protrusion 235 may have a thickness of approximately ⅛ inch to ⅜ inch. External protrusion 235 may have a diameter less than the diameter of first protrusion 240 and the diameter of second protrusion 250, which diameter may be approximately ¾ inch to 2¼ inch. According to some embodiments, second protrusion 250 may be threaded and first end 120 of host tube 110 may be correspondingly threaded so that baffle stack 200 be accepted into host tube 110 and tightened securely by turning external protrusion 235 and/or hole 245. For example, male threads may be provided around an outer perimeter of second protrusion 250 and corresponding female threads may be provided around an inner perimeter of host tube 110, such that host tube 110 may be attached to baffle stack 200 via the corresponding male and female threads.

In one embodiment, external protrusion 235 may be in the shape of a hexagon such that external protrusion 235 may accept a hex wrench for turning baffle stack 200. In another embodiment, external protrusion 235 may be in the shape of an octagon such that external protrusion 235 may accept an octagon wrench for turning baffle stack 200. External protrusion 235 may be in any appropriate shape that may accept a tool, such as a socket, a ratchet, etc., for turning baffle stack 200. In the embodiment as shown, first end 210 may include hole 245. In the embodiment as shown, hole 245 may be generally circular in shape. It is contemplated that hole 245 may be hexagonal in shape such that an Allen wrench may be used for turning baffle stack 200. Also as shown, hole 245 may include a threaded portion 255. Threaded portion 255 may be slightly larger in diameter as compared to the diameter of hole 245. For example, threaded portion 255 may be approximately ½ inches to ⅞ inches in diameter. A firearm barrel may include a corresponding threaded portion, such that baffle stack 200 may be attached to the firearm via threaded portion 255. In some embodiments, threaded portion 255 may include ½-28 UNS threads. However, other type of threads suitable for use with suppressor 100 may be used.

When a firearm is fired, propellant gases may be generated. These propellant gases may be generated for propelling a bullet out of an end of the firearm at a high velocity. Host tube 110 may retain the propellant gases as the gases travel through suppressor 100. Host tube 110 may also help to secure baffle stack 200 in place. The arrangement between host tube 110 and baffle stack 200 may facilitate the swirling of the propellant gases as they travel through suppressor 100. For example, each of plurality of chambers 280 may be generally spherical in shape, and each of plurality of recesses 290 may be generally partially spherical in shape. As shown in FIG. 3B, a cross-sectional view of each of plurality of recesses 290 may be generally in the shape of a semi-circle. In some embodiments, each of the plurality of chambers 280 may be approximately ¾ inch to 1⅞ inches in diameter. Each of the plurality of recesses 290 may be approximately ½ inch to 1½ inches in diameter. As shown in FIGS. 3A-B, the location of the plurality of recesses 290 may be symmetrical with respect to a longitudinal axis extending from first end 210 to second end 220 of baffle stack 200.

A chamber 280 may be in fluid communication with adjacent chambers 280, such that the propellant gases may travel from one chamber 280 to the next chamber 280. Similarly, a recess 290 may be in fluid communication with adjacent chambers 280, such that the propellant gases may travel from one recess 290 to adjacent chambers 280. One recess 290 may also be in fluid communication with adjacent recesses 290 via chambers 280, such that the propellant gases may travel from one recess 290 to the next recess 290 via one of the plurality of chambers 280. The shape of chambers 280 and recesses 290 may facilitate the swirling of the propellant gases inside suppressor 100. As the propellant gases travel from one chamber 280 to the next chamber 280 and from one recess 290 to the next recess 290, the velocity associated with the propellant gases may be reduced. As shown in FIGS. 3A-B, the propellant gases may travel from one chamber 280 to the next chamber 280 through one of the plurality of holes 260. Similarly, the propellant gases may travel from one recess 290 to the next recess 290 through one of the plurality of side holes 270. The propellant gases travel through suppressor 100 and exit second end 220 (or first end 210, depending on which end of suppressor 100 is attached to the firearm) in a slower and less violent manner. The slower and less violent exiting propellant gases results in a reduction in the sounds generated by firing of the firearm. It is contemplated that when assembled, there is a secured fit between host tube 110 and baffle stack 200. For example, it is contemplated that when suppressor 100 is assembled, there may be less than approximately 1/16 inch of gap between an inner surface (not shown) of host tube 110 and an outer surface (not shown) of baffle stack 200.

Referring back to FIG. 2, cap 300 may include an external protrusion 310, a hole 320, a first protrusion 330, a second protrusion 340, and a body section 350. In one embodiment, external protrusion 310 may be in the shape of a hexagon such that external protrusion 310 may accept a hex wrench for turning cap 300. In another embodiment, external protrusion 310 may be in the shape of an octagon such that external protrusion 310 may accept an octagon wrench for turning cap 300. External protrusion 310 may be in any appropriate shape that may accept a tool, such as a socket, a ratchet, etc., for turning cap 300. In the embodiment as shown, hole 320 is generally circular in shape. However, it is contemplated that hole 320 may be hexagonal in shape such that a hex wrench may be inserted into hole 320 and used for turning cap 300. Cap 300 may be threaded to be accepted into host tube 110 and to be threaded onto a firearm. The threads may vary to accept different thread pitches of a firearm. In some embodiments, the total length of cap 300 may be approximately 1 to 1½ inches. Cap 300 may be approximately 1 to 2 inches in diameter.

Figure 4C:
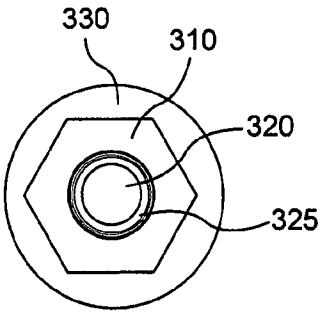
FIG. 4C is an end view of the cap of FIG. 2.
Figure 4A:
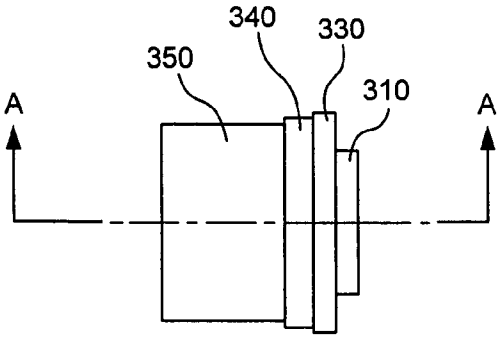
FIG. 4A is a side view of the cap of FIG. 2.
Figure 4B:
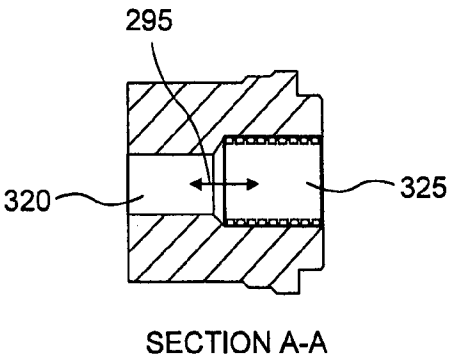
FIG. 4B is a cross-sectional view of the cap of taken along the line A-A in FIG. 4A.

FIGS. 4A-C show a side view, a cross-sectional view, and an end view of an exemplary embodiment of cap 300, respectively. In the embodiment as shown, hole 320 may include a threaded portion 325. In some embodiments, hole 320 may be similar in size to hole 230 of second end 220 of baffle stack 200, and may be approximately ¾ inch to 1½ inches in diameter. Threaded portion 325 may be slightly larger in diameter as compared to that of hole 320. For example, threaded portion 325 may be approximately ½ inches to ⅞ inches in diameter. FIGS. 3C and 4C represent similar illustrations of end views of exemplary embodiments of baffle stack 200 and cap 300, respectively. In some embodiments, the corresponding numbered elements from FIGS. 3C and 4C may have similar dimensions. For example, first protrusion NO may have similar dimensions as first protrusion 330, and second protrusion 250 may have similar dimensions as second protrusion 340. For another example, external protrusion 310 may have similar dimensions as external protrusion 235, and hole 320 may have similar dimensions as hole 245. In some embodiments, body section 350 may be approximately 6 inch to 10 inch in length and approximately 1 inch to 2 inches in diameter. By having similar dimensions in external protrusion 235 of baffle stack 200 and external protrusion 310 of cap 300, suppressor 100 may be attached to a firearm barrel either via first end 210 of baffle stack 200 or cap 300. The firearm barrel may include a corresponding threaded portion, such that suppressor 100 may be attached to the firearm via threaded portion 325 of cap 300 or suppressor 100 may be attached to the firearm barrel via threaded portion 255 of baffle stack 200. For example, male threads may be provided around an outer perimeter of the firearm barrel and corresponding female threads may be provided around an inner perimeter of threaded portion 325 of cap 300 (or threaded portion 255 of baffle stack 200), such that suppressor 100 may be attached to the firearm barrel via the corresponding male and female threads.

As shown in FIG. 3B, baffle stack 200 may include a path 295 extending from hole 230 through hole 245. As shown in FIG. 4B, path 295 may continue through cap 300, i.e., path 295 may extend from hole 320 through threaded portion 325. It is contemplated that path 295 may vary in diameter to accept calibers from 0.17 to 0.300 win magazines. It is contemplated that the propellant gases may travel from one end of suppressor 100 and exit an opposite end of suppressor 100 via path 295. Similarly, bullets may travel from one end of suppressor 100 and exit an opposite end of suppressor 100 via path 295.

The suppressor described herein may be manufactured by a process that facilitates later disassembly, when desired. First, a host tube 110 is provided. This component (as with other components) may be custom manufactured or purchased from another source. In some embodiments, host tube 110 may be generally hollow and generally cylindrical in shape. It is contemplated that host tube 110 may be in any other appropriate geometric shape. A monolithic baffle stack 200 may be provided. In some embodiments, monolithic baffle stack 200 may include a first end 210 including a hole 245. In some embodiments, monolithic baffle stack 200 may include a second end 220 including a hole 230, and second end 220 may be located at an opposite end of monolithic baffle stack 200. In some embodiments, monolithic baffle stack 200 may include a plurality of chambers 280 in fluid communication with each other via a plurality of holes 260, such that propellant gases may travel from one chamber 280 to an adjacent chamber 280. Similarly, in some embodiments, monolithic baffle stack 200 may include a plurality of recesses 290 in fluid communication with the plurality of chambers 280 via a plurality of side holes 270, such that propellant gases may travel from one recess 290 to an adjacent chamber 280. Propellant gases may also travel from one recess 290 to another recess 290, for example.

In one exemplary embodiment, first end 210 of monolithic baffle 200 may be secured to a first end 120 of host tube 110. A cap 300 may also be provided during the assembly process. In some embodiments, cap 300 may include a hole 320. Cap 300 may be secured to a second end 130 of host tube 110. A path 295 extends from hole 245 of first end 210 of monolithic baffle stack 200 through hole 320 of cap 300. Once suppressor 100 is attached to a firearm and that firearm is discharged, propellant gases will travel through the plurality of chambers 280, the plurality of recesses 290, and path 295. Those skilled in the art would appreciate that as the propellant gases travel through the plurality of chambers 280 and the plurality of recesses 290, the velocity associated with the propellant gases may be reduced, thus resulting in a reduction in the sounds that are generated by a firearm.

The nature in which the three components have been assembled allows for relatively easy disassembly. This may prove advantageous in efficient disassembly to service and/or replace selected components. For example, components of suppressor 100 may be removed for cleaning and/or inspection purposes. Those skilled in the art would appreciate that the repeated firing of ammunition may result in lead buildup inside a suppressor over time. Eventually, the lead buildup may be so severe that the suppressor is no longer functional or its performance is partially impaired. Sometimes the lead buildup may be so severe that a bullet may not be able to fit through the undersize hole in the baffle inside the suppressor. In addition to lead buildup, dirt may also be present inside the suppressor. Cleaning the various components of suppressor 100 on a regular or as-needed basis may help to reduce the lead and/or dirt buildup. The easy disassembly of suppressor 100 facilitates such cleaning.

Further, as discussed above, the various components of suppressor 100 may include threaded portions such that the components may be selectively secured with one another via the threaded portions. Those skilled in the art would also appreciate that because suppressor 100 may be disassembled easily, any component of suppressor 100 may be customized in order to be used with various calibers of firearms. For example, the diameters of host tube 110, baffle stack 200, and/or cap 300 may be altered and manufactured according to customer's specification. Similarly, the pitches and/or the diameters of the threaded portions of host tube 110, baffle stack 200, and/or cap 300 may be altered and manufactured according to customer's specification. The ability to customize in this manner allows the various components of suppressor 100 to be used with firearms of different manufacturers and also with different caliber firearms.

It will be apparent to those skilled in the art that various modifications and variations can be made in the disclosed suppressor. It will also be apparent to those skilled in the art that while the method of assembling a suppressor is disclosed with a specific order, that specific order is not required. Other embodiments will be apparent to those skilled in the art from consideration of the specification and practice of the disclosed embodiments herein. It is intended that the specification and examples be considered as exemplary only, with a true scope of the disclosure being indicated by the following claims.

What is claimed is:

1. A suppressor for suppressing sounds generated by the discharge of a firearm, the discharge generating propellant gases, the suppressor comprising:

a host tube, the host tube being generally hollow and generally cylindrical;

a monolithic baffle stack inserted within the host tube and secured to a first end of the host tube, the monolithic baffle stack including:

a first end including a first hole, a second end including a second hole, the second end located opposite the first end of the monolithic baffle stack, a plurality of chambers in fluid communication with each other via a plurality of holes;

a plurality of curved recesses in fluid communication with the plurality of chambers via a plurality of side holes, the side holes being enclosed by the host tube, wherein the curved recesses are concave with respect to the host tube, wherein the plurality of curved recesses are not annular recesses;

a cap secured to a second end of the host tube, the cap including a hole; and a path extending from the first hole adjacent the first end of the monolithic baffle stack through the hole of the cap, wherein the plurality of chambers, the plurality of recesses, and the path are configured to allow propellant gases to travel therethrough.

2. The suppressor of claim 1, wherein the first end of the monolithic baffle stack includes a threaded portion and the first end of the host tube includes a corresponding threaded portion such that the first end of the monolithic baffle stack is selectively secured to the first end of the host tube.

3. The suppressor of claim 1, wherein the cap includes a threaded first end and the second end of the host tube includes a corresponding threaded portion such that the threaded first end of the cap is selectively secured to the second end of the host tube.

4. The suppressor of claim 1, wherein the monolithic baffle stack includes no welded joints.

5. The suppressor of claim 1, wherein the monolithic baffle stack includes at least six chambers in fluid communication with each other via the plurality of holes.

6. The suppressor of claim 1, wherein each of the plurality of chambers is spherical in shape.

7. The suppressor of claim 1, wherein the monolithic baffle stack is between about 5½ inches to about 9 inches in length.

8. The suppressor of claim 1, wherein the first end of the monolithic baffle stack includes an external protrusion configured to accept a tool for removing the monolithic baffle stack from the host tube.

9. The suppressor of claim 1, wherein the first end of the cap includes an external protrusion configured to accept a tool for removing the cap from the host tube.

10. A suppressor for suppressing sounds generated by the discharge of a firearm, the discharge generating propellant gases, the suppressor comprising:

a host tube, the host tube being generally hollow and generally cylindrical;

a baffle stack selectively secured to a first end of the host tube via corresponding threaded portions, the baffle stack including:

a plurality of chambers in fluid communication with each other via a plurality of holes, and a plurality of curved recesses in fluid communication with the plurality of chambers via a plurality of side holes, the side holes being enclosed by the host tube, wherein one or more of the plurality of curved recesses is concave with respect to the host tube, wherein the one or more of the plurality of curved recesses has a first depth at a first circumferential location on the baffle stack and a second depth at a second circumferential location on the baffle stack, the first depth being greater than the second depth;

a cap selectively secured to a second end of the host tube via corresponding threaded portions, the cap including a hole; and a path extending from the first hole adjacent the first end of the baffle stack through the hole of the cap, wherein the plurality of chambers, the plurality of recesses, and the path are configured to allow propellant gases to travel therethrough.

11. The suppressor of claim 10, wherein the first end of the baffle stack includes a threaded portion and the first end of the host tube includes a corresponding threaded portion such that the first end of the baffle stack is selectively secured to the first end of the host tube.

12. The suppressor of claim 10, wherein the cap includes a threaded first end and the second end of the host tube includes a corresponding threaded portion such that the threaded first end of the cap is selectively secured to the second end of the host tube.

13. The suppressor of claim 10, wherein the baffle stack includes no welded joints.

14. The suppressor of claim 10, wherein the plurality of side holes are symmetrical with respect to a longitudinal axis extending from the first end of the baffle stack to the second end of the baffle stack.

15. The suppressor of claim 10, wherein the suppressor is made of titanium.

16. The suppressor of claim 11, wherein one of a pitch or a diameter of the threaded portion of the first end of the baffle stack is adjustable such that the baffle stack can be secured to firearms of different caliber.

17. A suppressor for suppressing sounds generated by the discharge of a firearm, the suppressor comprising:

a host tube;

a monolithic baffle stack inserted within the host tube, the monolithic baffle stack including:

a first end including a first hole, a second end including a second hole, the second end located opposite the first end of the monolithic baffle stack, a plurality of chambers in fluid communication with each other via a plurality of holes;

a plurality of recesses in fluid communication with the plurality of chambers via a plurality of side holes, the side holes being enclosed by the host tube, wherein a void space of each recess is semi-circular in shape, and an outer boundary of each recess is elliptically shaped; and a path through the monolithic baffle stack, wherein the plurality of chambers, the plurality of recesses, and the path are configured to allow propellant gases to travel therethrough.

18. The suppressor of claim 17, wherein the first end of the monolithic baffle stack includes a threaded portion and the first end of the host tube includes a corresponding threaded portion such that the first end of the monolithic baffle stack is selectively secured to the first end of the host tube.

19. The suppressor of claim 17, wherein each of the plurality of chambers is spherical in shape.

20. The suppressor of claim 17, wherein the monolithic baffle stack includes no welded joints.

* * * * *